US007140608B2

(12) United States Patent
Wang

(10) Patent No.: US 7,140,608 B2
(45) Date of Patent: Nov. 28, 2006

(54) BILL BOX FOR BILL ACCEPTOR

(75) Inventor: Nai-I Wang, Taipei (TW)

(73) Assignee: International Currency Technology Corporation, Taipei (TW)

( * ) Notice: Subject to any disclaimer, the term of this patent is extended or adjusted under 35 U.S.C. 154(b) by 139 days.

(21) Appl. No.: 10/904,194

(22) Filed: Oct. 28, 2004

(65) Prior Publication Data

US 2006/0097442 A1 May 11, 2006

(51) Int. Cl.
*E05G 1/00* (2006.01)

(52) U.S. Cl. ..... 271/145; 109/47

(58) Field of Classification Search ..... 109/24.1, 109/47, 55; 271/145, 162–164; 221/197, 221/198, 287; 220/559, 23.86, 23.87; 232/15, 232/16

See application file for complete search history.

(56) References Cited

U.S. PATENT DOCUMENTS 1,344,142 A * 6/1920 Meyer ..... 221/81
1,347,693 A * 7/1920 Garfinkel ..... 109/47
1,685,219 A * 9/1928 Lorentzen ..... 232/15
2,524,907 A * 10/1950 Harris ..... 232/15
2,580,752 A * 1/1952 Forester ..... 232/15
3,773,252 A * 11/1973 Jensen ..... 232/1 R
3,974,961 A * 8/1976 Dominick et al. ..... 232/16
4,418,628 A * 12/1983 Cahill ..... 109/19
4,434,931 A * 3/1984 Hunt et al. ..... 232/15
4,493,454 A * 1/1985 Giebelhausen et al. ..... 232/15
4,552,075 A * 11/1985 Glasson et al. ..... 109/52
4,552,354 A * 11/1985 Kokubo et al. ..... 271/163
4,570,548 A * 2/1986 Martin et al. ..... 109/66
4,597,340 A * 7/1986 Huckle ..... 109/45
4,638,746 A * 1/1987 Ishigure ..... 109/52
4,648,327 A * 3/1987 Toth et al. ..... 109/57
4,655,368 A * 4/1987 Bateman et al. ..... 221/4
4,676,432 A * 6/1987 Wake ..... 232/43.2
4,798,316 A * 1/1989 Martin et al. ..... 232/43.1
4,854,570 A * 8/1989 Martin et al. ..... 271/162
4,877,179 A * 10/1989 Baker et al. ..... 232/7
4,890,766 A * 1/1990 Martin et al. ..... 221/198
4,949,901 A * 8/1990 Harris ..... 232/15
4,997,128 A * 3/1991 Suris ..... 232/16
5,052,730 A * 10/1991 Frank et al. ..... 292/201
5,071,032 A * 12/1991 Thornton et al. ..... 221/154
5,100,022 A * 3/1992 Fukudome et al. ..... 221/198
5,209,395 A * 5/1993 Zouzoulas et al. ..... 232/15
5,234,209 A * 8/1993 Weigel et al. ..... 271/145
5,480,134 A * 1/1996 Weber ..... 271/145
5,509,646 A * 4/1996 Chang ..... 271/177
5,653,436 A * 8/1997 Zouzoulas ..... 271/177
5,662,202 A * 9/1997 Suris ..... 194/206
5,784,973 A * 7/1998 Mercer et al. ..... 109/59 R
5,836,510 A * 11/1998 Kirchner ..... 232/15
5,996,888 A * 12/1999 Gromatzky ..... 232/15
6,059,090 A * 5/2000 Davis et al. ..... 194/350
6,089,560 A * 7/2000 Fujiwara ..... 271/4.1
6,105,858 A * 8/2000 Chien ..... 232/1 D (Continued)

FOREIGN PATENT DOCUMENTS

KR 2003-0101535 * 10/2003

*Primary Examiner*—Patrick Mackey
*Assistant Examiner*—Jeremy R Severson

(57) ABSTRACT

A bill box used in the bill receiver of a coin exchanger for accommodating banknotes received by the bill receiver is disclosed to have a gate installed in the first chamber thereof and a driving mechanism controllable to move the gate between two positions to close/open the first chamber.

3 Claims, 8 Drawing Sheets

U.S. PATENT DOCUMENTS 6,286,716 B1 * 9/2001 Izawa et al. ..... 221/197
6,533,261 B1 * 3/2003 Katou et al. ..... 271/3.12
6,651,796 B1 * 11/2003 Chou ..... 194/350
6,659,452 B1 * 12/2003 Abe et al. ..... 271/181
6,712,352 B1 * 3/2004 Bergeron et al. ..... 271/180
6,805,344 B1 * 10/2004 Abe et al. ..... 271/157
6,820,872 B1 * 11/2004 Ko et al. ..... 271/162
6,823,995 B1 * 11/2004 Mukai ..... 209/534
6,832,862 B1 * 12/2004 Giese ..... 396/518
6,871,602 B1 * 3/2005 McCracken et al. ..... 109/59 R
2004/0119225 A1 * 6/2004 Yamamiya ..... 271/180
2004/0188920 A1 * 9/2004 Washington et al. ..... 271/145
2004/0188921 A1 * 9/2004 Washington et al. ..... 271/145
2004/0195758 A1 * 10/2004 Cost ..... 271/177
2004/0211708 A1 * 10/2004 Liu et al. ..... 209/534
2004/0212143 A1 * 10/2004 Yoshioka et al. ..... 271/176
2004/0245709 A1 * 12/2004 Takeuchi ..... 271/177
2005/0035533 A1 * 2/2005 Giese ..... 271/145
2005/0140084 A1 * 6/2005 Lee ..... 271/145
2005/0200072 A1 * 9/2005 Sawayama et al. ..... 271/207

* cited by examiner

BILL BOX FOR BILL ACCEPTOR

BACKGROUND OF THE INVENTION

1. Field of the Invention

The present invention relates to a bill box for use in the bill acceptor of a coin exchanger and more particularly, to such a bill box that has a security arrangement that automatically close the first chamber to prevent others from stealing received banknotes.

2. Description of the Related Art

Following fast development of technology, our mode of living has been changed. Various automatic vending machines (card dispensers, ticket vending machines, coin exchanging machines, etc.) are used everywhere to sell any of a variety of products without the service of any serviceman. After installation of an automatic vending machine, the provider does not send any person to take care of the machine unless a new supply or repair work is needed. During the vulnerable period where no guard is in presence to protect the machine, criminals may try different measures or use different tools to steal banknotes from the machine. Further, because several machines may be installed in one spot and because the bill box of a conventional automatic vending machine is not provided with a security system, workers who entrusted to safeguard may pilfer banknotes from the machines.

FIGS. 7 and 8 show a bill receiver according to the prior art. This design of bill receiver comprises a receiver main unit A and a bill box B fastened to one side of the receiver main unit A for holding banknotes received by the receiver main unit A. The bill box B has a back door B1 that can be opened by the user, spring members B2 connected between the back door B1 and a front pressure board B3 and adapted to push the front pressure board B3 toward the receiver main unit A. Further, the bill box B has a plurality of coupling blocks B4 respectively coupled to respective L-shaped coupling grooves A1 of the receiver main unit A, and a sliding locking member B5 for moving into a lock hole A2 of the receiver main unit A to lock the bill box B to the receiver main unit A. When wishing to remove the bill box B from the receiver main unit A, move the sliding locking member B5 away from the lock hole A2 to unlock the bill box B, and then push the bill box B outwards to disengage the coupling blocks B4 from the respective L-shaped coupling grooves A1. This design of bill receiver still has drawbacks as outlined hereinafter.

When the receiver main unit A carried a banknote into the inside of the bill box B, the bill box B is kept in an open status. Therefore, an evil person can use fasten a steel wire or adhesive means to a banknote, and then insert the banknote into the bill receiver to purchase the desired product or service, and then pull the steel wire or adhesive means to carry the inserted banknote out of the bill box B for a repeat application.

After removal of the bill box B from the receiver main unit A, the bill box B is not well protected, and an intentional person can easily take storage banknotes out of the bill box B.

Therefore, it is important to provide a bill box for bill receiver/acceptor that has a security structure to protect received banknotes against thieves.

SUMMARY OF THE INVENTION

The present invention has been accomplished under the circumstances in view. According to one aspect of the present invention, the bill box comprises a gate installed in the first chamber thereof, and a driving mechanism controllable to move the gate between two positions to close/open the first chamber so as to prevent others from inserting tool means into the inside of the bill box to steal received banknotes. According to another aspect of the present invention, the bill box is detachable from the bill acceptor only when the gate closed the first chamber. According to still another aspect of the present invention, a knob is provided for one-way rotate by the user to close the gate manually upon failure of the motor or power supply.

DETAILED DESCRIPTION OF THE EMBODIMENTS

Figure 1:
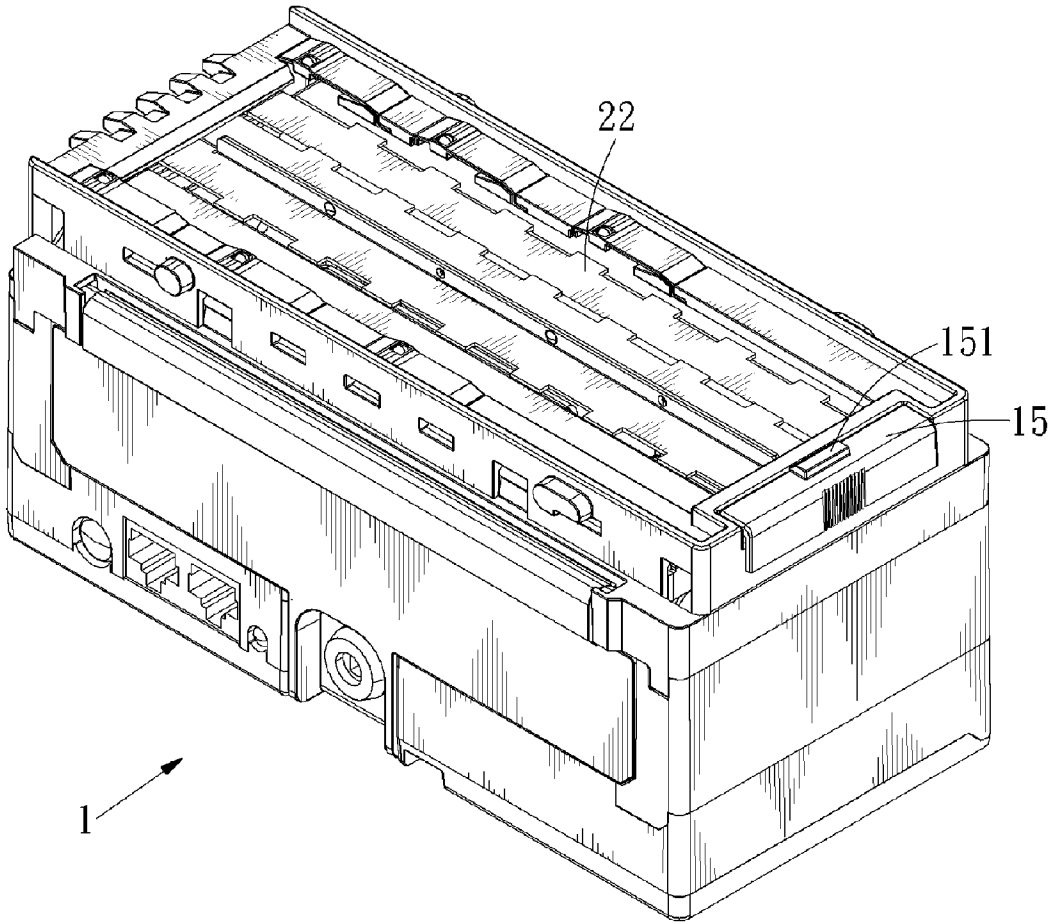
FIG. 1 is a perspective view of a bill box according to the present invention.

Referring to FIGS. 1~4, a bill box in accordance with the present invention is shown comprised of a bill box 1, a gate 2, and a driving mechanism 3.

The bill box 1 comprises a first chamber 11, a second chamber 12 opposite to the first chamber 11 for accommodating the driving mechanism 3, a pressure board 13 suspended in the first chamber 11, a plurality of conical springs 14 stopped between the bottom wall of the first chamber 11 and the pressure board 13 to impart an outward pressure to the pressure board 13, and a mounting frame 15 covered on the first chamber 11. The mounting frame 15 is a rectangular open frame having a rod 151.

The gate 2 comprises a transmission unit 21 and two gate boards 22. The transmission unit 21 comprises a transmission rod 213, two drive gears 211 respectively mounted in the left and right sides of the bill box 1 and fixedly connected to the two distal ends of the transmission rod 213, two transmission gear trains 212 respectively coupled to the drive gears 211, two push members 2121 respectively coupled to two reversed gears of the transmission gear trains 212 and turnable by the transmission gear trains 212 about a respective axis within a predetermined angle, and a worm gear 214 fixedly mounted on the transmission rod 213. The gate boards 22 are coupled to the transmission unit 21 within the mounting frame 15, and driven by the transmission unit 21 to close/open the first chamber 11. Each gate board 22 comprises two sliding rails 221 downwardly disposed at the two distal ends thereof. Each sliding rail 221 has a sliding slot 222, and a sliding pin 223 slidably mounted in the sliding slot 222 and coupled to one push member 2121 of one of the transmission gear trains 212.

The driving mechanism 3 comprises a motor 31 mounted inside the second chamber 12 of the bill box 1, a worm 32 fixedly axially connected to the output shaft of the motor 31 and meshed with the worm gear 214 of the transmission units 21, and a knob 33 connected to one end of the worm 32 opposite to the motor 31.

Further, the bill box 1 is connectable to a bill receiver 4 for coin exchanging machine. The bill receiver 4 has a movable bill pressure board 41 movable in and out of the bill box 1, and a hole 42 coupled to the retaining rod 151 of the mounting frame 15.

The assembly procedure of the bill box 1 is outlined hereinafter with reference to FIGS. 1–4 again. The conical springs 14 are fastened to the bottom wall of the first chamber 11 of the bill box 1, and then the pressure board 13 is put in the first chamber 11 and supported on the conical springs 14, and then the transmission unit 21 of the gate 2 is installed in the left and right sides of the first chamber 11 of the bill box 1, and then the gate boards 22 of the gate 2 are put in the first chamber 11 to have the sliding pins 223 respectively coupled to the push members 2121 of the transmission gear trains 212 of the transmission unit 21, and then the motor 31 is installed in the second chamber 12 of the bill box 1 to have the worm 32 meshed with the worm gear 214 of the transmission unit 21, and then the mounting frame 15 is covered on the first chamber 11 of the bill box 1 and coupled to the bill receiver 4 of the coin exchanging machine (not shown).

Figure 2:
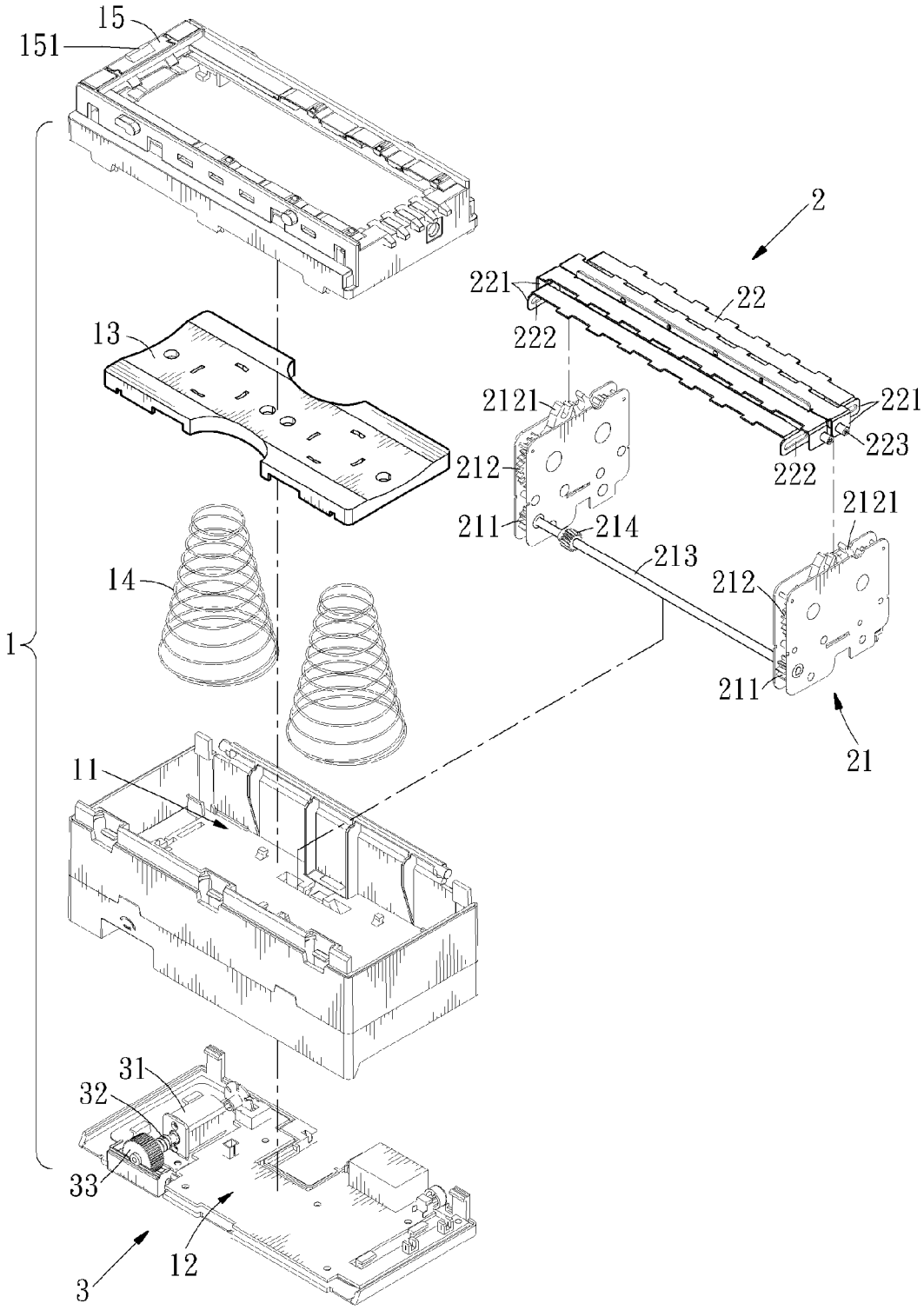
FIG. 2 is an exploded view of the bill box according to the present invention.
Figure 3:
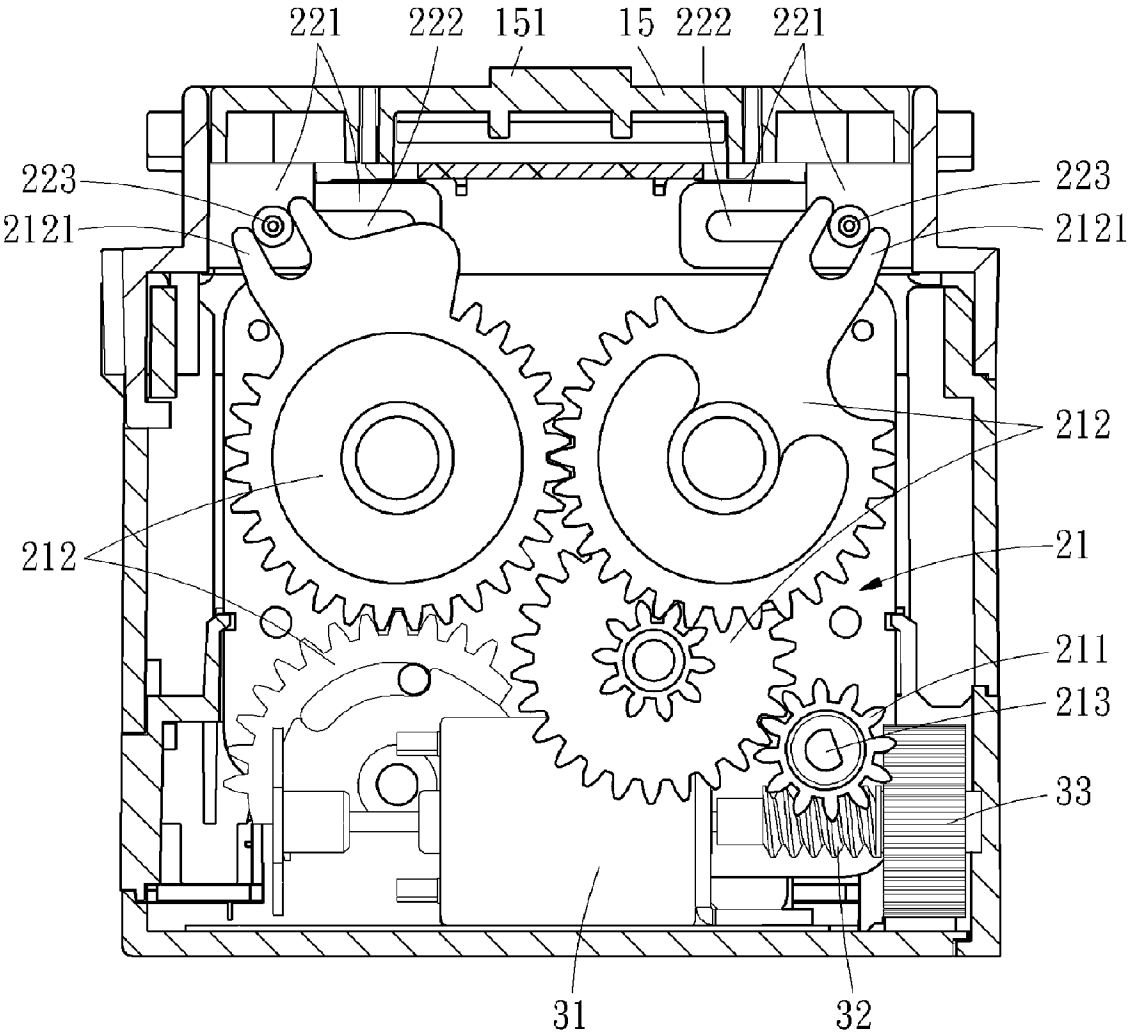
FIG. 3 is a side view in section in an enlarged scale of the bill box according to the present invention.
Figure 4:
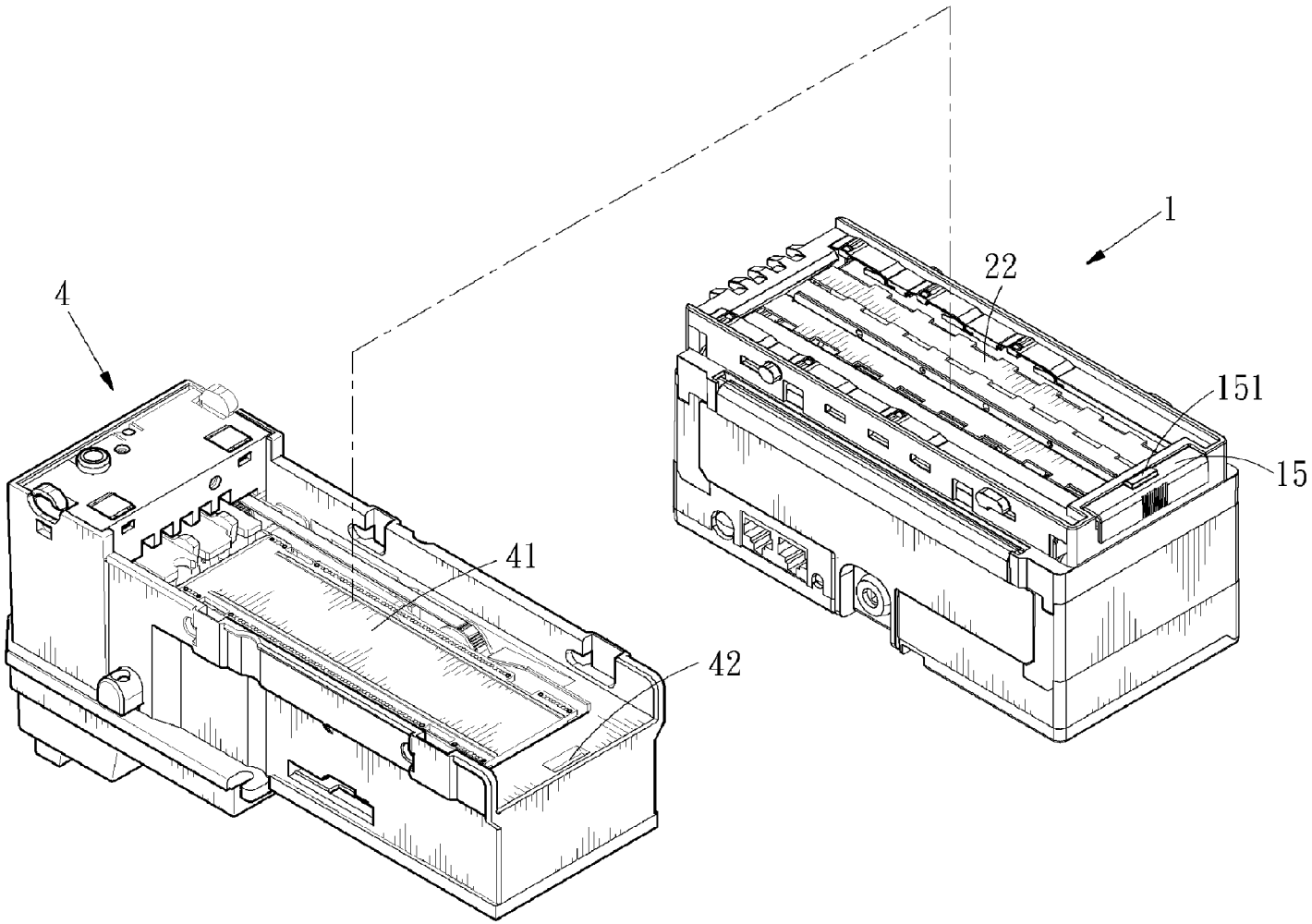
FIG. 4 illustrates the relationship between the bill box and a bill receiver according to the present invention.

Referring to FIGS. 2~4 again, when a banknote inserted into the bill insertion slot of the coin exchanging machine, the sensor of the coin exchanging machine detects the signal and then drives the motor 31 to rotate the worm 32 in one direction, thereby causing the worm 32 to rotate the worm gear 214 and the transmission rod 213, and therefore the sliding pins 223 in the sliding slot 222 are forced by the push members 2121 of the transmission gear trains 212 to move the gate boards 22 apart and to further open the first chamber 11, for enabling the bill pressure board 41 of the bill receiver 4 to press the received banknote onto the pressure board 13 inside of the receiving chamber 11 of the bill box 1. At this time, the conical springs 14 impart an outward pressure to the pressure board 13, thereby causing the pressure board 13 to press the received banknote onto the inner side of the gate boards 22. Thereafter, the motor 31 is controlled to reverse the worm 32 and to further move the gate boards 22 toward each other, and therefore the gate boards 22 of the gate 2 are closed.

When the bill box 1 is full, start the motor 31 to close the gate boards 22 of the gate 2, and then press the mounting frame 15 to disengage the retaining rod 151 from the retaining hole 42 of the bill receiver 4, and then remove the bill box 1 from the bill receiver 4. If the gate boards 22 of the gate 2 are not closed, the user cannot press the mounting frame 15 to disengage the retaining rod 151 from the retaining hole 42 of the bill receiver 4. In case the motor 31 failed or the power failed during closing action of the gate boards 22, the user can rotate the knob 33 in one direction to close the gate boards 22 manually. The knob 33 has a one-way bearing (not shown) mounted on the inside and coupled to the worm 32 opposite to the motor 31. Therefore, when rotating the knob 33 in the reversed direction, the knob 33 will run idle.

Figure 5:
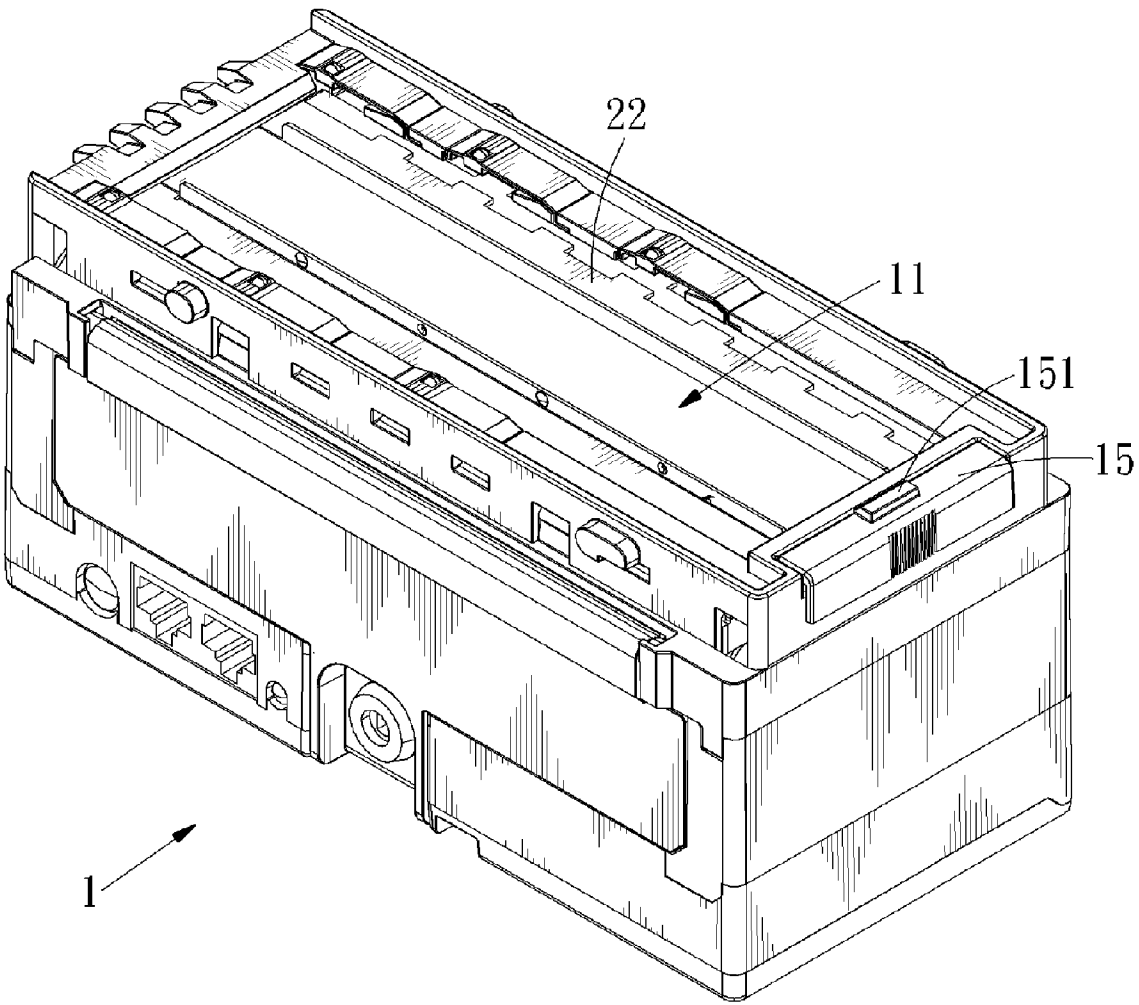
FIG. 5 is a perspective view of the present invention, showing an open status of the gate boards of the gate of the bill box.

Referring to FIG. 5, the gate boards 22 of the gate 2 can be opened to a different extent subject to the size of the banknote received. Therefore, the bill box 1 of the present invention is practical for receiving different banknotes.

Figure 6:
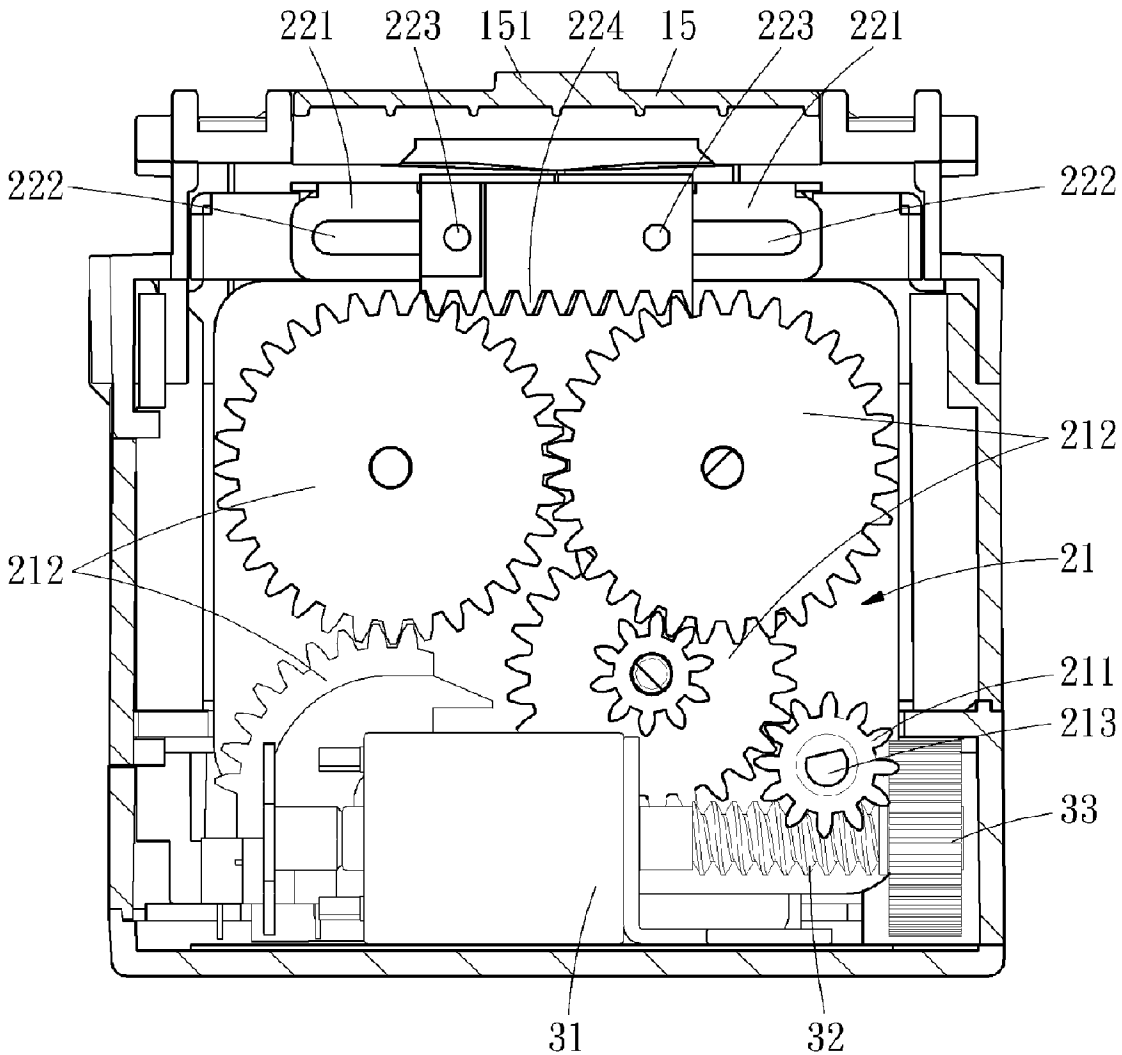
FIG. 6 is a sectional side view of an alternate form of the bill box according to the present invention.
Figure 7:
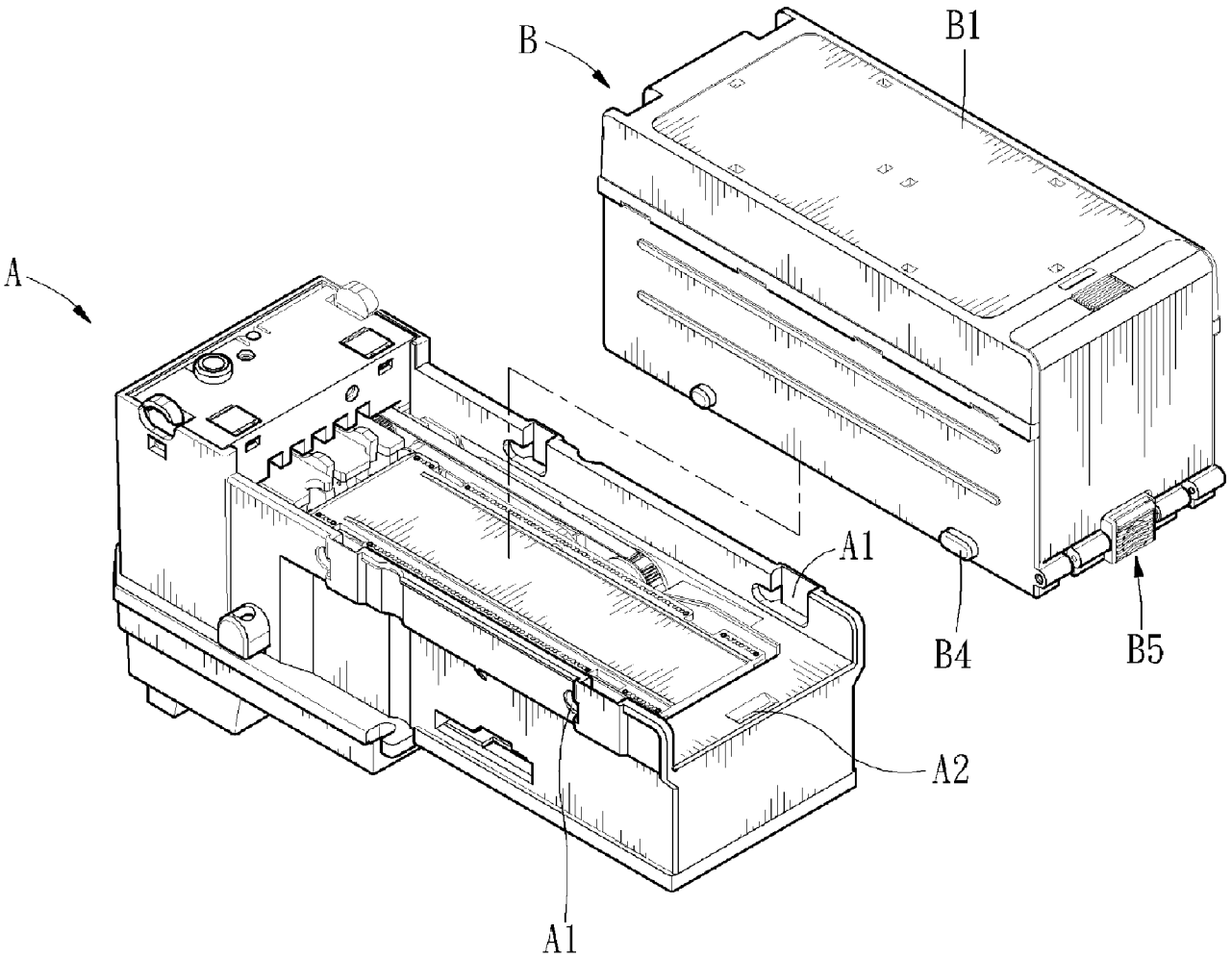
PRIOR ART FIG. 7
FIG. 7 is an exploded view of a bill receiver according to the prior art.
Figure 8:
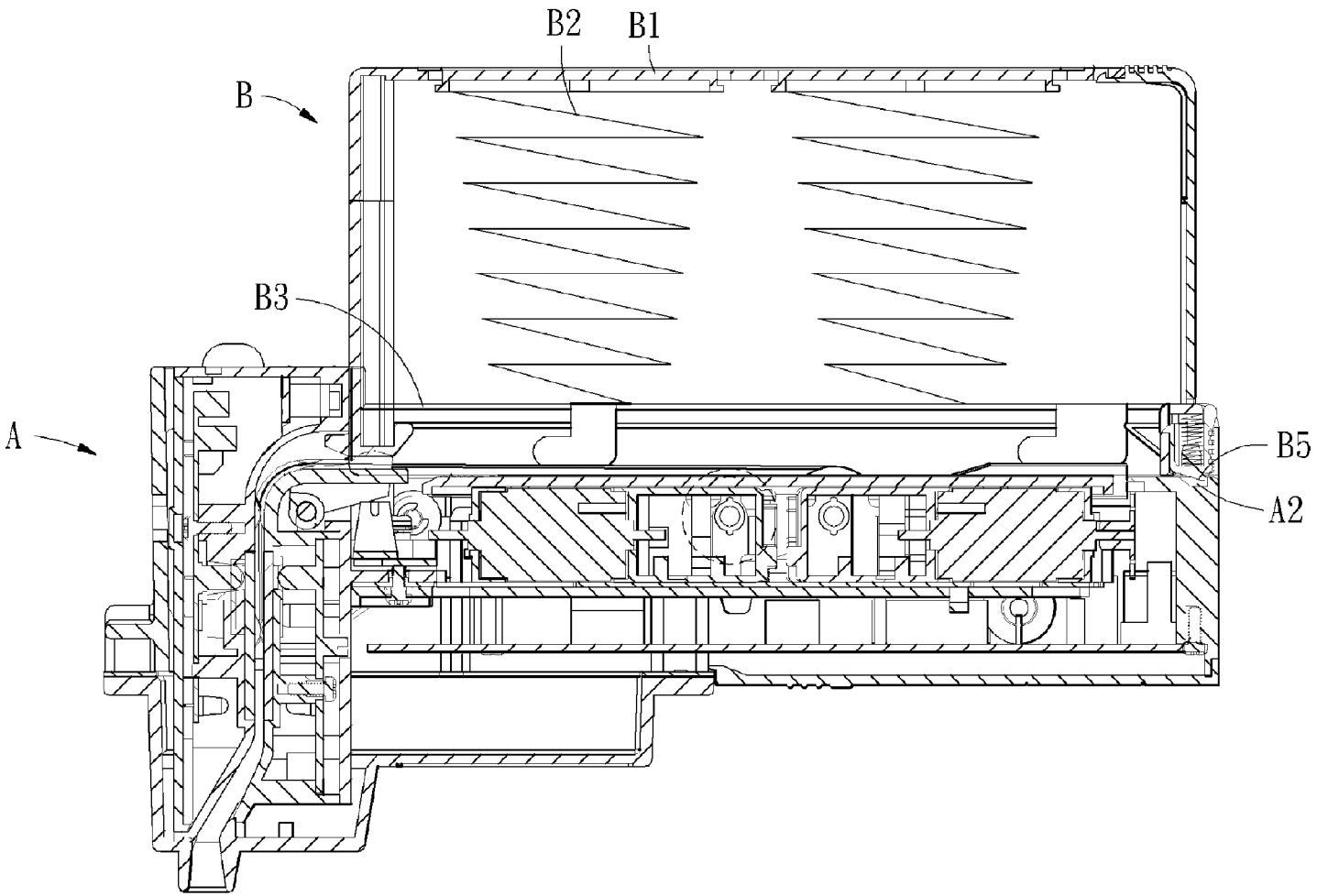
PRIOR ART FIG.8
FIG. 8 is a sectional assembly view in an enlarged scale of the bill receiver shown in FIG. 7.

FIG. 6 is a sectional view of an alternate form of the bill box according to the present invention. According to this embodiment, each gate board 22 comprises two sliding rails 221 downwardly disposed at the two distal ends thereof. Each sliding rail 221 has a sliding slot 222, a sliding pin 223 slidably mounted in the sliding slot 222, and a rack 224 fixedly fastened to the sliding pin 223 and meshed with one of two reversed gears of one of the transmission gear trains 212 of the transmission unit 21. When rotating the motor 31 in one direction, the racks 224 are driven by the transmission gear trans 212 to move the gate boards 22 relative to each other between the close position and the open position.

According to the aforesaid two embodiments, the driving mechanism 3 are controlled to drive the transmission units 21, causing the transmission units 21 to move the gate boards 22 between the close position and the open position. However, any of a variety of transmission means such as transmission bearing, belt, rope, chain, or rail means may be used to substitute for the drive gears 211 and transmission gear trains 212.

As indicated above, the main feature of the present invention is the design of the gate 2 for the protection of the bill box 1 and the use of the driving mechanism 3 that drives the transmission unit 21 to move the gate boards 22 to close/open the first chamber 11 of the bill box 1, preventing others from stealing banknotes from the bill box 1.

In general, the invention achieves the following advantages.

1. Each time the bill pressure board 41 of the bill receiver 4 pressed one received banknote onto the inside of the first chamber 11 of the bill box 1, the gate boards 22 of the gate 2 are immediately moved to close the first chamber 11, preventing others from inserting a steel wire, tape, or any of a variety of tool means into the inside of the bill box 1 to steal received banknotes.

2. After removal of the bill box 1 from the bill receiver 4, the gate boards 22 of the gate 2 are maintained closed, protecting received banknotes well on the inside of the bill box 1.

When power failed or the driving mechanism 3 failed, the user can rotate the knob 33 in one direction to close the gate boards 22, for enabling the bill box 1 to be removed from the bill receiver 4.

A prototype of bill box for bill acceptor has been constructed with the features of FIGS. 1~6. The bill box for bill acceptor functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bill box used in a bill receiver for accommodating banknotes received by said bill receiver, comprising a gate installed in a first chamber thereof and a driving mechanism controllable to move said gate between two positions to close/open said first chamber, wherein said driving mechanism comprises a motor, a worm coupled between said motor and said gate and rotatable by said motor to move said gate between said two positions to close/open said first chamber, and a knob connected to said worm for enabling a user to rotate said worm in one direction to move said gate to manually close said first chamber.

2. The bill box as claimed in claim 1, wherein said gate comprises a transmission unit installed in left and right sides inside of the bill box and coupled to said driving mechanism for driving by said driving mechanism, and a plurality of gate boards coupled to said transmission unit and movable by said transmission unit between two positions to close/open said first chamber.

3. The bill box as claimed in claim 2, wherein said transmission unit comprises a transmission rod coupled to said driving mechanism, two drive gears respectively fixedly mounted on two distal ends of said transmission unit, and two transmission gear trains respectively coupled between said drive gears and said gate boards.

* * * * *